US010636375B2

(12) United States Patent
Jo et al.

(10) Patent No.: US 10,636,375 B2
(45) Date of Patent: Apr. 28, 2020

(54) DISPLAY APPARATUS AND A METHOD OF DRIVING THE SAME

(71) Applicant: SAMSUNG DISPLAY CO., LTD., Yongin-si, Gyeonggi-Do (KR)

(72) Inventors: Guhui Jo, Suwon-si (KR); Sun-Koo Kang, Seoul (KR); Wontae Kim, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 421 days.

(21) Appl. No.: 15/461,931

(22) Filed: Mar. 17, 2017

(65) Prior Publication Data

US 2017/0323611 A1 Nov. 9, 2017

(30) Foreign Application Priority Data

May 9, 2016 (KR) ..... 10-2016-0056680

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2310/027* (2013.01); *G09G 2310/0286* (2013.01); *G09G 2310/0291* (2013.01); *G09G 2310/08* (2013.01)

(58) Field of Classification Search
CPC .. G09G 3/3677; G09G 3/3696; G09G 3/3688; G09G 2310/08; G09G 2310/0286; G09G 2310/027; G09G 2310/0291
See application file for complete search history.

(56) References Cited

U.S. PATENT DOCUMENTS

2003/0098833 A1* 5/2003 Sekido ..... G09G 3/3688 345/87
2008/0225029 A1* 9/2008 Park ..... G09G 3/20 345/208
2010/0194731 A1* 8/2010 Hiratsuka ..... G09G 3/3688 345/211
2011/0074745 A1* 3/2011 Chang ..... G09G 3/20 345/204
2013/0257847 A1* 10/2013 Lee ..... G09G 5/00 345/213
2014/0232713 A1* 8/2014 Hsu ..... G09G 3/3685 345/213

FOREIGN PATENT DOCUMENTS

KR 1020150078356 7/2015
KR 1020150090634 8/2015

* cited by examiner

*Primary Examiner* — Kent W Chang
*Assistant Examiner* — Andrew Lee
(74) *Attorney, Agent, or Firm* — F. Chau & Associates, LLC

(57) ABSTRACT

A display apparatus includes a display panel and a data driver. The display panel is configured to display an image and includes first through fourth data line groups. The first and second data line groups are adjacent to each other, and the third and fourth data line groups are adjacent to each other. The data driver includes a first data driving circuit configured to output first data voltages to the second data line group later than to the first data line group by a first delay time, and configured to output second data voltages to the fourth data line group later than to the third data line group by a second delay time that is different from the first delay time.

20 Claims, 10 Drawing Sheets

FIG. 7A

| SH<1> | SH<0> | MODE |
|---|---|---|
| L | L | V-SH |
| L | H | L-SH |
| H | L | R-SH |
| H | H | A-SH |

FIG. 7B

| B1<1><br>B2<1><br>B3<1><br>B4<1> | B1<0><br>B2<0><br>B3<0><br>B4<0> | UNIT DELAY TIME |
|---|---|---|
| L | L | 1UI |
| L | H | 2UI |
| H | L | 3UI |
| H | H | 4UI |

FIG. 7C

| M<1> | M<0> | RELATIVE UNIT DELAY |
|---|---|---|
| L | L | x1 |
| L | H | x2 |
| H | L | x3 |
| H | H | x4 |

| M2<0> | RELATIVE UNIT DELAY |
|---|---|
| H | Mx2 |
| L | Mx1 |

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2016-0056680, filed on May 9, 2016 in the Korean Intellectual Property Office (KIPO), the disclosure of which is incorporated by reference herein in its entirety.

TECHNICAL FIELD

Exemplary embodiments of the present inventive concept relate to display devices, and more particularly, to display apparatuses and methods of driving the display apparatuses.

DISCUSSION OF RELATED ART

Generally, a liquid crystal display (LCD) apparatus includes a first substrate including a pixel electrode, a second substrate including a common electrode, and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

The LCD apparatus further includes a display panel and a panel driver. The display panel includes a plurality of gate lines, a plurality of data lines, and a plurality of pixels connected to the gate lines and the data lines. The panel driver includes a gate driver for providing gate signals to the gate lines and a data driver for providing data voltages to the data lines.

The gate driver includes a plurality of switching elements. The switching elements are controlled by a clock signal and generate the gate signals. The gate signals may be delayed according to a relative position in the display panel due to a resistive-capacitive (RC) delay.

SUMMARY

According to an exemplary embodiment of the present inventive concept, a display apparatus includes a display panel and a display driver. The display panel is configured to display an image and includes first through fourth data line groups. The first and second data line groups are adjacent to each other, and the third and fourth data line groups are adjacent to each other. The data driver includes a first data driving circuit configured to output first data voltages to the second data line group later than to the first data line group by a first delay time, and configured to output second data voltages to the fourth data line group later than to the third data line group by a second delay time that is different from the first delay time.

In an exemplary embodiment of the present inventive concept, the data driver may further include a multi phase clock generator configured to generate a plurality of multi phase clock signals in response to a clock signal. The first data driving circuit may be configured to synchronize the first and second data voltages with the plurality of multi phase clock signals, and output the first and second data voltages.

In an exemplary embodiment of the present inventive concept, the first data driving circuit may be configured to synchronize the first data voltages with a first multi phase clock signal and the second data voltages with a second multi phase clock signal. Each of the first and second multi phase clock signals may be one of the plurality of multi phase clock signals, and the second multi phase clock signal is different from the first multi phase clock signal.

In an exemplary embodiment of the present inventive concept, the plurality of multi phase clock signals may have a time gap of a first unit time between one another, and the first and second delay times may be multiples of the first unit time.

In an exemplary embodiment of the present inventive concept, the first data line group, the second data line group, the third data line group, and the fourth data line group may be sequentially disposed.

In an exemplary embodiment of the present inventive concept, the first data line group is disposed at a first side of the second data line group, a second side of the second data line group is adjacent to a first side of the fourth data line group, and the third data line group is disposed adjacent to a second side of the fourth data line group.

In an exemplary embodiment of the present inventive concept, the display apparatus may further include a timing controller configured to generate a delay control signal and output the delay control signal to the first data driving circuit. The delay control signal includes delay information about the first and second delay times.

In an exemplary embodiment of the present inventive concept, the timing controller may be configured to output the delay control signal during vertical blank durations between each frame.

In an exemplary embodiment of the present inventive concept, the delay information may further include a number of data lines included in each of the first through fourth data line groups.

In an exemplary embodiment of the present inventive concept, the first through fourth data line groups may include substantially the same number of data lines.

In an exemplary embodiment of the present inventive concept, the data driver may further include a second data driving circuit.

According to an exemplary embodiment of the present inventive concept, in a method of driving a display apparatus including a display panel including first through fourth data line groups, the method includes outputting first data voltages to the second data line group later than to the first data line group by a first delay time, outputting second data voltages to the fourth data line group later than to the third data line group by a second delay time that is different from the first delay time, and displaying an image in response to the first and second data voltages.

In an exemplary embodiment of the present inventive concept, the method may further include generating a plurality of multi phase clock signals in response to a clock signal. Outputting the first and second data voltages may include synchronizing the first and second data voltages with the plurality of multi phase clock signals.

In an exemplary embodiment of the present inventive concept, the plurality of multi phase clock signals may have a time gap of a first unit time between one another, and the first and second delay times may be multiples of the first unit time.

In an exemplary embodiment of the present inventive concept, the method may further include generating a delay control signal including information about the first and second delay times.

In an exemplary embodiment of the present inventive concept, the method may further include outputting the delay control signal during vertical blank periods between each frame.

According to an exemplary embodiment of the present inventive concept, a display apparatus includes a display panel configured to display an image and including a plurality of blocks each including a plurality of data line groups, and a data driver configured to output data voltages. Each of the plurality of blocks has a different time gap between the plurality of data line groups include therein for outputting the data voltages.

In an exemplary embodiment of the present inventive concept, the display apparatus may further include a timing controller configured to generate a delay control signal and output the delay control signal to the data driver. The delay control signal includes delay information about differences in time gaps of the plurality of blocks.

In an exemplary embodiment of the present inventive concept, the delay information may further include a delay direction of the data voltages for each of the plurality of blocks.

In an exemplary embodiment of the present inventive concept, the data driver includes a shift register, a latch, a digital-to-analog converter, a multi phase clock generator, and a buffer. The shift register is configured to receive a horizontal start signal and a clock signal and generate a plurality of latch control signals. The latch is configured to receive the plurality of latch control signals, a delay control signal, a data signal, and a load signal, and output the data signal. The digital-to-analog converter is configured to receive the data signal from the latch and a gamma reference voltage to generate the data voltages. The multi phase clock generator is configured to receive the clock signal and generate a plurality of multi phase clock signals. The buffer is configured to receive the data voltages from the digital-to-analog converter, and output the data voltages to the plurality of blocks in response to the multi phase clock signals.

BRIEF DESCRIPTION OF THE DRAWINGS

The above and other features of the present inventive concept will become more apparent by describing in detail exemplary embodiments thereof with reference to the accompanying drawings.

FIGS. 7A through 7C are tables illustrating driving modes according to data allocated to the packet of FIG. 6 according to exemplary embodiments of the present inventive concept.

DETAILED DESCRIPTION OF EMBODIMENTS

Figure 1:
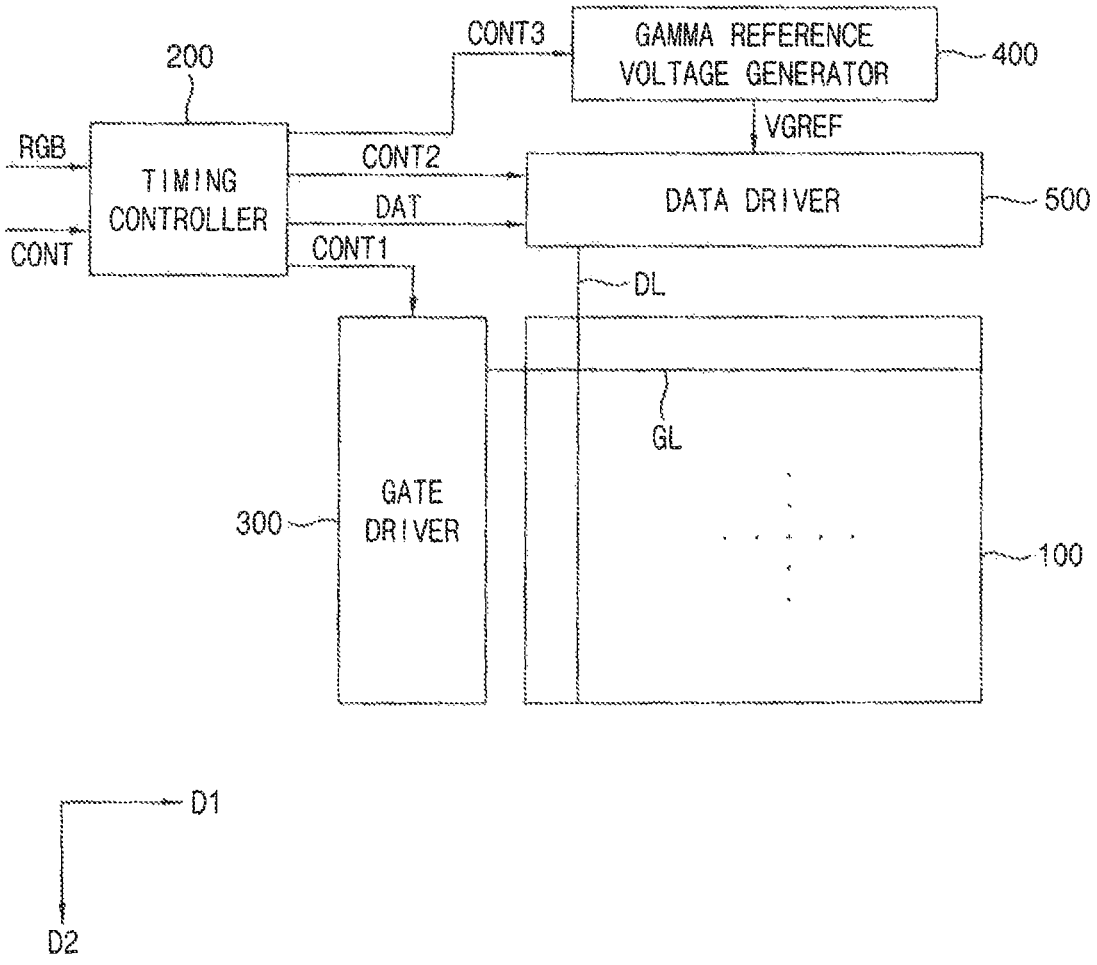
FIG. 1 is a block diagram illustrating a display apparatus according to an exemplary embodiment of the present inventive concept.

Exemplary embodiments of the present inventive concept will be described more fully hereinafter with reference to the accompanying drawings. Like reference numerals may refer to like elements throughout this application.

Exemplary embodiments of the present inventive concept provide a display apparatus capable of increasing display quality.

Exemplary embodiments of the present inventive concept also provide a method of driving the display apparatus.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 includes a display region for displaying an image and a peripheral region adjacent to the display region.

The display panel 100 includes a plurality of gate lines GL, a plurality of data lines DL, and a plurality of pixels electrically connected to the plurality of gate lines GL and the plurality of data lines DL. The plurality of gate lines GL extend in a first direction D1 and the plurality of data lines DL extend in a second direction D2 crossing (e.g., substantially perpendicular to) the first direction D1.

According to an exemplary embodiment of the present inventive concept, each of the pixels may include a switching element, a liquid crystal capacitor, and a storage capacitor. The liquid crystal capacitor and the storage capacitor may be electrically connected to the switching element. The pixels may be arranged in a matrix configuration.

The display panel 100 will be explained in detail below with reference to FIG. 2.

The timing controller 200 receives input image data RGB and an input control signal CONT from an external device (e.g., a host). The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DAT in response to the input image data RGB and the input control signal CONT.

The timing controller 200 generates the first control signal CONT1 for controlling operations of the gate driver 300 in response to the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 in response to the input control signal CONT, and outputs the second control signal CONT2 to the data driver 500. The second control signal CONT2 may include a horizontal start signal and a load signal. The second control signal CONT2 may further include a clock signal and a delay control signal.

The second control signal CONT2 will be explained in detail below with reference to FIGS. 5 and 6.

The timing controller 200 generates the data signal DAT using the input image data RGB. The timing controller 200 outputs the data signal DAT to the data driver 500. The data signal DAT may be substantially the same as the input image data RGB, or the data signal DAT may be compensated image data generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT.

The timing controller 200 generates the third control signal CONT3 for controlling operations of the gamma reference voltage generator 400 in response to the input control signal CONT, and outputs the third control signal CONT3 to the gamma reference voltage generator 400.

The gate driver 300 generates gate signals for driving the plurality of gate lines GL in response to the first control signal CONT1 received from the timing controller 200. The gate driver 300 sequentially outputs the gate signals to the plurality of gate lines GL.

According to an exemplary embodiment of the present inventive concept, the gate driver 300 may be directly mounted on the display panel 100, or may be connected to the display panel 100 as a tape carrier package (TCP) type. Alternatively, the gate driver 300 may be integrated in the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

According to an exemplary embodiment of the present inventive concept, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels using the gamma reference voltage VGREF. The data driver 500 outputs the data voltages to the plurality of data lines DL.

According to an exemplary embodiment of the present inventive concept, the data driver 500 may be directly mounted on the display panel 100, or may be connected to the display panel 100 as a TCP type. Alternatively, the data driver 500 may be integrated in the peripheral region of the display panel 100.

The data driver 500 will be explained in detail below with reference to FIGS. 2 and 3.

Figure 2:
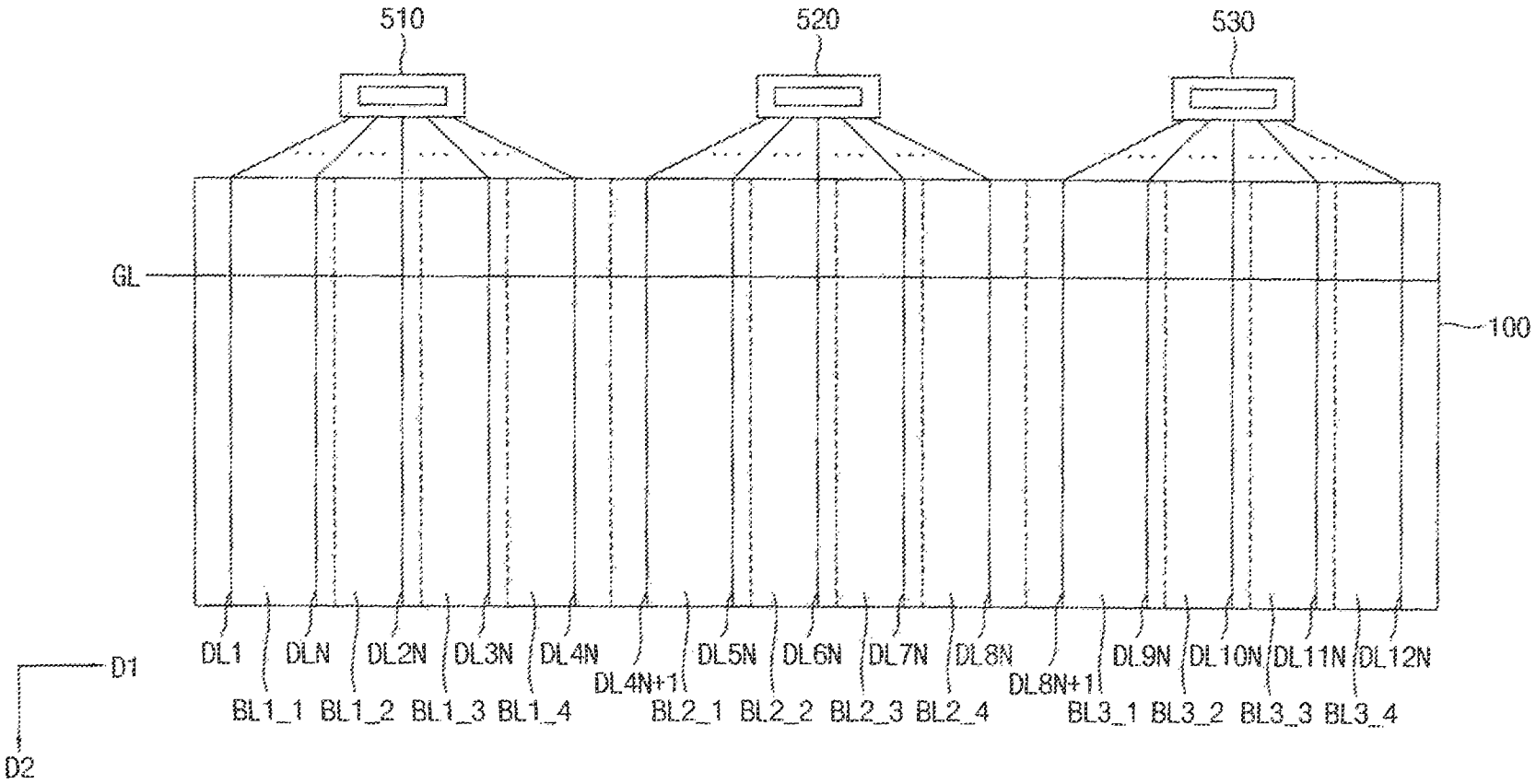
FIG. 2 is a diagram illustrating a display panel and a data driver included in the display apparatus of FIG. 1 according to an exemplary embodiment of the present inventive concept.

FIG. 2 is a diagram illustrating a display panel and a data driver included in the display apparatus of FIG. 1 according to an exemplary embodiment of the present inventive concept.

Referring to FIGS. 1 and 2, the data driver 500 may include a plurality of data driving circuits. For example, the data driver 500 may include a first data driving circuit 510, a second data driving circuit 520, and a third data driving circuit 530.

As described above, the display panel 100 includes the plurality of gate lines GL and the plurality of data lines DL. For example, the display panel 100 may include first through 12N-th data lines DL1~DL12N. N is a natural number.

The first through 4N-th data lines DL1~DL4N may be connected to the first data driving circuit 510 and may be driven by the first data driving circuit 510. The (4N+1)-th through 8N-th data lines DL(4N+1)~DL8N may be connected to the second data driving circuit 520 and may be driven by the second data driving circuit 520. The (8N+1)-th through 12N-th data lines DL(8N+1)~DL12N may be connected to the third data driving circuit 530 and may be driven by the third data driving circuit 530.

The display panel 100 is divided into a plurality of blocks along the first direction D1. For example, the display panel 100 may be divided into first through fourth blocks BL1_1~BL1_4 of a first area driven by the first data driving circuit 510, first through fourth blocks BL2_1~BL2_4 of a second area driven by the second data driving circuit 520, and first through fourth blocks BL3_1~BL3_4 of a third area driven by the third data driving circuit 530.

The first through N-th data lines DL1~DLN may be disposed in the first block BL1_1 of the first area. The (N+1)-th through 2N-th data lines DL(N+1)~DL2N may be disposed in the second block BL1_2 of the first area. The (2N+1)-th through 3N-th data lines DL(2N+1)~DL3N may be disposed in the third block BL1_3 of the first area. The (3N+1)-th through 4N-th data lines DL(3N+1)~DL4N may be disposed in the fourth block BL1_4 of the first area.

The (4N+1)-th through 5N-th data lines DL(4N+1) ~DLSN may be disposed in the first block BL2_1 of the second area. The (5N+1)-th through 6N-th data lines DL(5N+1)~DL6N may be disposed in the second block BL2_2 of the second area. The (6N+1)-th through 7N-th data lines DL(6N+1)~DL7N may be disposed in the third block BL2_3 of the second area. The (7N+1)-th through 8N-th data lines DL(7N+1)~DL8N may be disposed in the fourth block BL2_4 of the second area.

The (8N+1)-th through 9N-th data lines DL(8N+1) ~DL9N may be disposed in the first block BL3_1 of the third area. The (9N+1)-th through 10N-th data lines DL(9N+1) ~DL10N may be disposed in the second block BL3_2 of the third area. The (10N+1)-th through 11N-th data lines DL(10N+1)~DL11N may be disposed in the third block BL3_3 of the third area. The (11N+1)-th through 12N-th data lines DL(11N+1)~DL12N may be disposed in the fourth block BL3_4 of the third area.

Figure 3:
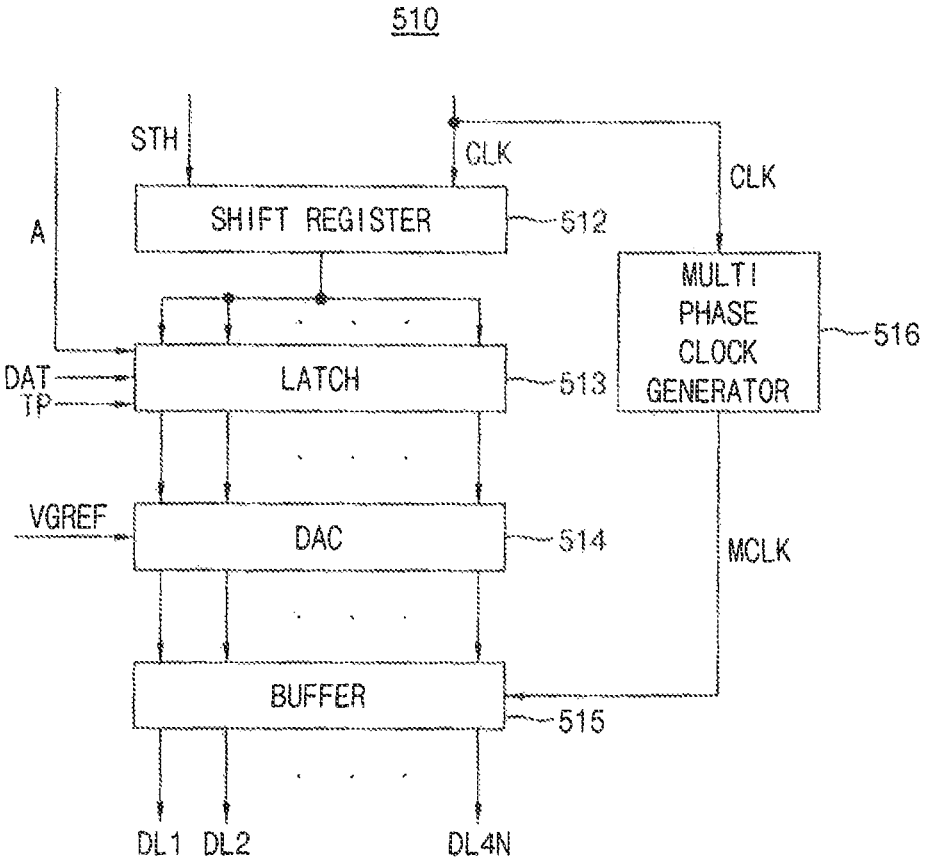
FIG. 3 is a block diagram illustrating a data driving circuit included in the data driver of FIG. 2 according to an exemplary embodiment of the present inventive concept.
Figure 4:
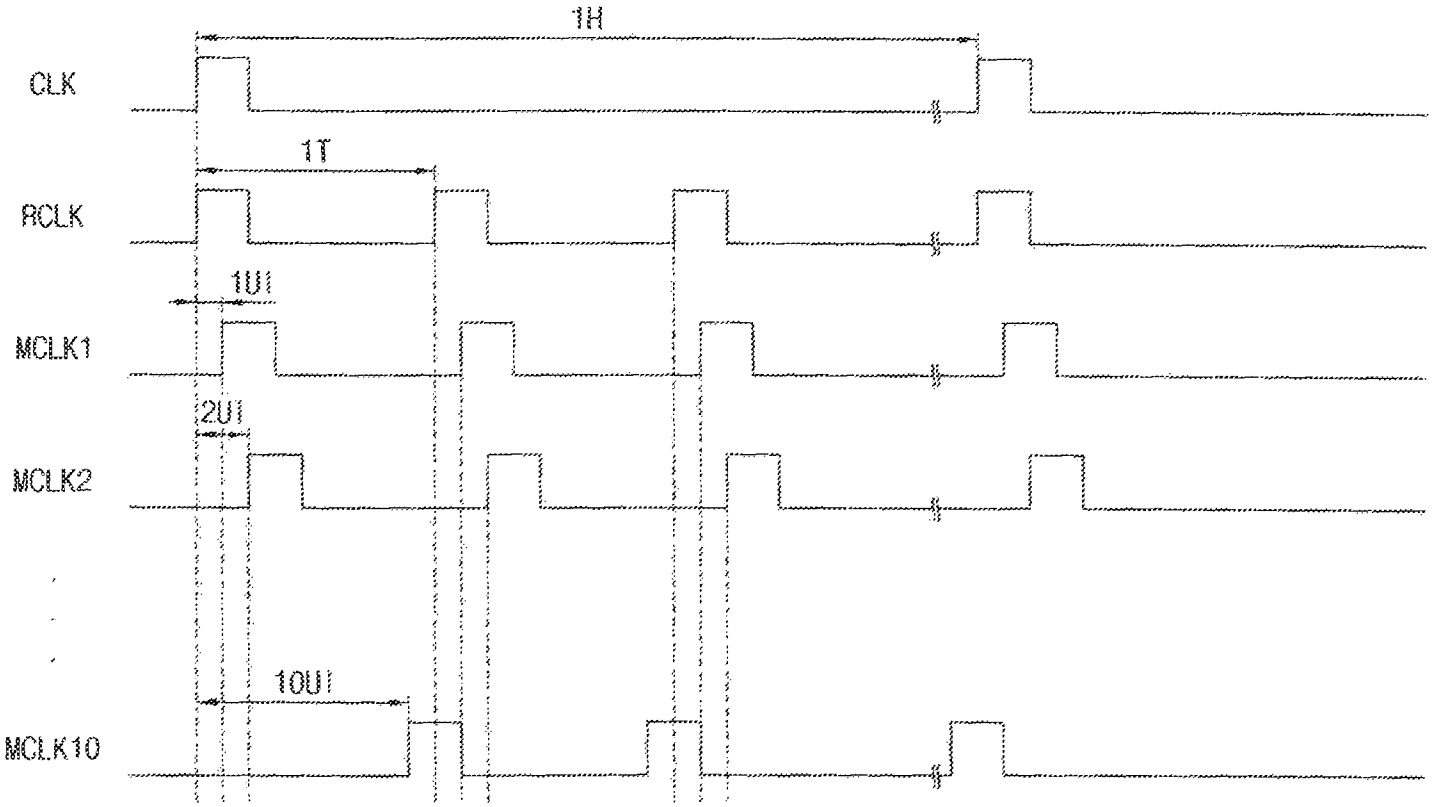
FIG. 4 is a diagram illustrating clock signals generated by the data driving circuit of FIG. 3 according to an exemplary embodiment of the present inventive concept.

FIG. 3 is a block diagram illustrating a data driving circuit included in the data driver of FIG. 2 according to an exemplary embodiment of the present inventive concept. FIG. 4 is a diagram illustrating clock signals generated by the data driving circuit of FIG. 3 according to an exemplary embodiment of the present inventive concept.

Referring to FIGS. 1 through 3, the first data driving circuit 510 includes a shift register 512, a latch 513, a digital-to-analog converter (DAC) 514, and a buffer 515. The first data driving circuit 510 may further include a multi phase clock generator 516.

The second control signal CONT2 may include a horizontal start signal STH, a clock signal CLK, a load signal TP, and a delay control signal A.

The shift register 512 receives the horizontal start signal STH and the clock signal CLK. The shift register 512 generates latch control signals in response to the horizontal start signal STH and the clock signal CLK, and outputs the latch control signals to the latch 513.

The latch 513 stores the data signal DAT in response to the latch control signals. The latch 513 may output the data signal DAT to the DAC 514 in response to the load signal TP and the delay control signal A.

The delay control signal A will be explained in detail below with reference to FIGS. 5 and 6.

The DAC 514 generates data voltages in response to the data signal DAT, output by the latch 513, and the gamma reference voltage VGREF.

The multi phase clock generator 516 may generate a reference clock signal and a plurality of multi phase clock signals MCLK in response to the clock signal CLK.

Referring to FIGS. 3 and 4, the clock signal CLK may have a pulse for each horizontal period 1H.

The multi phase clock generator 516 may generate a reference clock signal RCLK in response to the clock signal CLK. The reference clock signal RCLK may have a pulse for each first period 1T.

The multi phase clock generator 516 may generate first through tenth multi phase clock signals MCLK1~MCLK10 in response to the clock signal CLK. For example, the multi phase clock generator 516 may generate the first multi phase clock signal MCLK1. The first multi phase clock signal MCLK1 may have a pulse for each first period 1T, and may be delayed in comparison with the reference clock signal RCLK by a first unit time 1UI. The multi phase clock generator 516 may generate the second multi phase clock signal MCLK2. The second multi phase clock signal MCLK2 may have a pulse for each first period 1T, and may be delayed in comparison with the reference clock signal RCLK by a second unit time 2UI. The second unit time 2UI may be twice the first unit time 1UI. The multi phase clock generator 516 may generate the tenth multi phase clock signal MCLK10. The tenth multi phase clock signal MCLK10 may have a pulse for each first period 1T, and may be delayed in comparison with the reference clock signal RCLK by a tenth unit time 10UI. The tenth unit time 10UI may be ten times the first unit time 1UI. In this case, the first period 1T may be eleven times the first unit time 1UI.

Referring to FIGS. 1 through 4, the buffer 515 outputs the data voltages to the first through 4N-th data lines DL1~DL4N in response to the multi phase clock signals MCLK.

The second and third data driving circuits 520 and 530 may have substantially the same configuration as the first data driving circuit 510.

Figure 5:
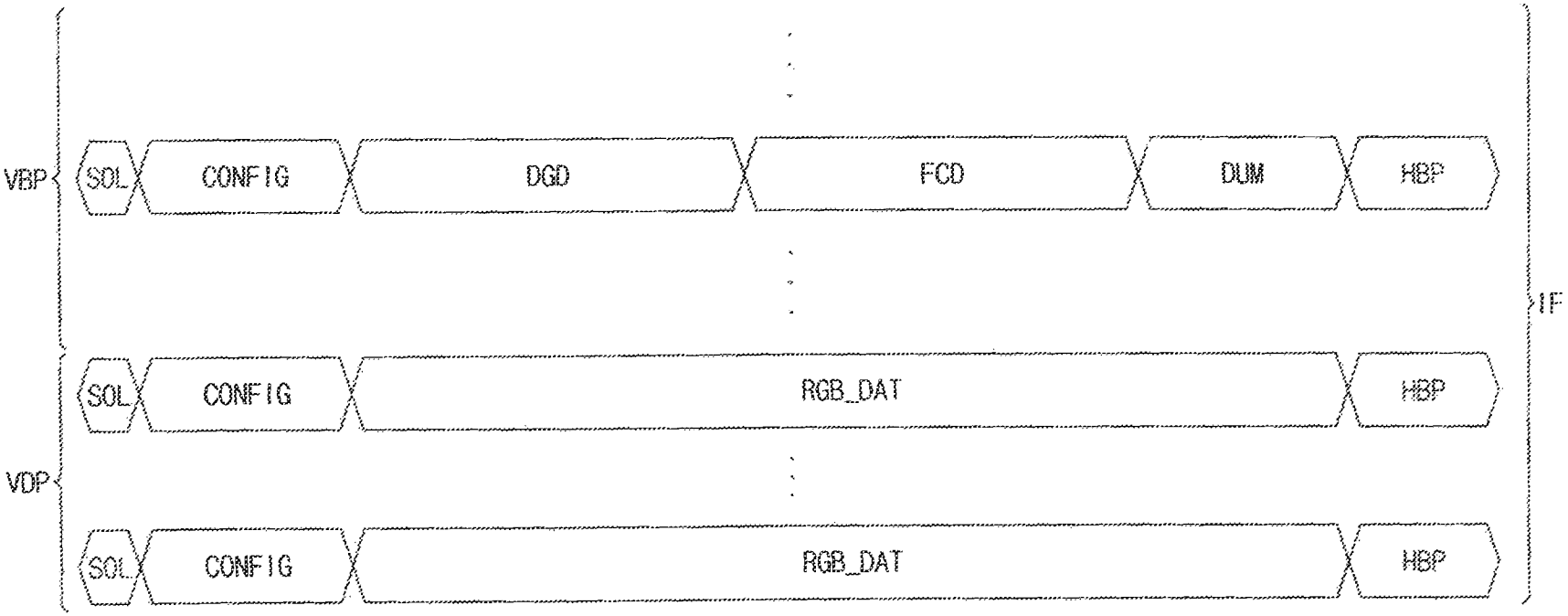
FIG. 5 is a diagram illustrating a packet of a signal generated by a timing controller included in the display apparatus of FIG. 1 according to an exemplary embodiment of the present inventive concept.

FIG. 5 is a diagram illustrating a packet of a signal generated by a timing controller included in the display apparatus of FIG. 1 according to an exemplary embodiment of the present inventive concept. FIG. 6 is a diagram illustrating a part of the packet of FIG. 5 according to an exemplary embodiment of the present inventive concept.

Figure 6:
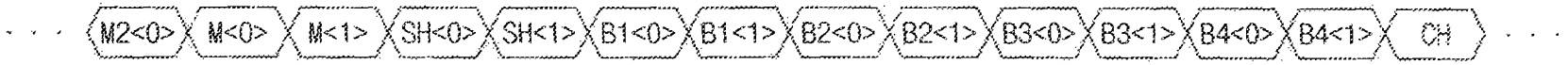
FIG. 6 is a diagram illustrating a part of the packet of FIG. 5 according to an exemplary embodiment of the present inventive concept.

Referring to FIGS. 1 through 6, the timing controller 200 outputs the data signal DAT and the second control signal CONT2 to the first data driving circuit 510. FIG. 6 is a diagram illustrating a packet of the signals output to the first data driving circuit 510 by the timing controller 200 during one frame 1F.

The one frame 1F includes a vertical blank period VBP and an active period VDP. At the beginning of each of the vertical blank period VBP and the active period VDP, the timing controller 200 outputs a start of line signal SOL. At the end of each of the vertical blank period VBP and the active period VDP, the timing controller 200 outputs a horizontal blank period signal HBP.

The timing controller 200 outputs digital gamma data DGD and frame configuration data FCD during the vertical blank period VBP. The frame configuration data FCD may include the delay control signal A. Additionally, the timing controller 200 may output a dummy signal DUM after outputting the digital gamma data DGD and the frame configuration data FCD.

The delay control signal A may include information about a delay timing for outputting the data voltages of each block of the display panel 100. For example, the delay control signal A may include first through fourth block delay signals B1~B4 of 2 bits each, which concern delay times corresponding to the first through fourth blocks BL1_1~BL1_4 of the first area, respectively. The delay control signal A may also include a delay direction signal SH of 2 bits concerning a delay direction of the data voltages of the first area. The delay control signal A may further include a delay coefficient signal M of 2 bits and a second delay coefficient signal M2 of 1 bit concerning a delay time coefficient of the first area. Additionally, the delay control signal A may include a unit signal CH of 1 bit concerning a unit number of delayed data lines of the first area.

The first through fourth block delay signals B1~B4, the delay direction signal SH, the delay coefficient signal M, the second delay coefficient signal M2, and the unit signal CH will be explained in detail below with reference to FIGS. 7A through 7C.

Referring to FIG. 5, the timing controller 200 outputs a configuration signal CONFIG and a data signal RGB_DAT of each horizontal period during the active period VDP.

The timing controller 200 may output substantially the same signals to the second and third data driving circuits 520 and 530 as to the first data driving circuit 510.

FIGS. 7A through 7C are tables illustrating driving modes according to data allocated to the packet of FIG. 6 according to exemplary embodiments of the present inventive concept.

FIG. 7A is a table illustrating a direction of delay of the first area according to data allocated to each bit of the delay direction signal SH of FIG. 6.

Referring to FIGS. 6 and 7A, the delay direction signal SH includes a first bit SH<1> and a second bit SH<0>. When a low signal L is allocated to the first bit SH<1> and the low signal L is allocated to the second bit SH<0>, the data voltage is delayed in a direction from an edge to a center in the first area (V-SH mode). When the low signal L is allocated to the first bit SH<1> and a high signal H is allocated to the second bit SH<0>, the data voltage is delayed in a direction from left to right in the first area (L-SH mode). When the high signal H is allocated to the first bit SH<1> and the low signal L is allocated to the second bit SH<0>, the data voltage is delayed in a direction from right to left in the first area (R-SH mode). When the high signal H is allocated to the first bit SH<1> and the high signal H is allocated to the second bit SH<0>, the first area is delayed using an analog method (A-SH mode).

FIG. 7B is a table illustrating a delay time of each block according to data allocated to each bit of first through fourth block delay signals of FIG. 6 according to an exemplary embodiment of the present inventive concept.

Referring to FIGS. 4, 6, and 7B, the first through fourth block delay signals B1~B4 include first bits B1<1>~B4<1>, respectively, and second bits B1<0>~B4<0>, respectively. When the low signal L is allocated to the first bits B1<1>~B4<1> and the low signal L is allocated to the second bits B1<0>~B4<0>, a time gap or unit delay time between data line groups for outputting data voltages of each of the first through fourth blocks BL1_1~BL1_4 is the first unit time 1UI. When the low signal L is allocated to the first bits B1<1>~B4<1> and the high signal H is allocated to the second bits B1<0>~B4<0>, the time gap is the second unit time 2UI. When the high signal H is allocated to the first bits B1<1>~B4<1> and the low signal L is allocated to the second bits B1<0>~B4<0>, the time gap is the third unit time 3UI. When the high signal H is allocated to the first bits B1<1>~B4<1> and the high signal H is allocated to the second bits B1<0>~B4<0>, the time gap is the fourth unit time 4UI. Each of the data line groups may include a portion of data lines among the plurality of data lines DL.

FIG. 7C is a table illustrating a delay time coefficient according to data allocated to each bit of a delay coefficient signal and a second delay coefficient signal of FIG. 6 according to an exemplary embodiment of the present inventive concept.

Referring to FIGS. 4, 6, 7B, and 7C, the delay coefficient signal M includes a first bit M<1> and a second bit M<0>, and the second delay coefficient signal M2 includes a first bit M2<0>. When the low signal L is allocated to the first bit M<1> and the low signal L is allocated to the second bit M<0>, a delay time by the first through fourth block delay signals B1 B4 is multiplied by 1 (e.g., the relative unit delay is ×1). When the low signal L is allocated to the first bit M<1> and the high signal H is allocated to the second bit M<0>, the delay time is multiplied by 2. When the high signal H is allocated to the first bit M<1> and the low signal L is allocated to the second bit M<0>, the delay time is multiplied by 3. When the high signal H is allocated to the first bit M<1> and the high signal H is allocated to the second bit M<0>, the delay time is multiplied by 4.

When the low signal L is allocated to the first bit M2<0>, a delay time by the delay coefficient signal M is multiplied by 1. When the high signal H is allocated to the first bit M2<0>, the delay time by the delay coefficient signal M is multiplied by 2.

Accordingly, each of the first through fourth blocks BL1_1~BL1_4 of the first area may have different delay times from the first unit time 1UI to a 32nd unit time 32UI.

Referring to FIGS. 3, 4, 6, 7B, and 7C, for example, to make the first block BL1_1 of the first area have a delay time of the first unit time 1UI, an LL signal for the first block delay signal B1, an LL signal for the delay coefficient signal M, and an L signal for the second delay coefficient signal M2 are provided. In this case, data voltages are output to a first data line group of the first block BL1_1 of the first area in response to the first multi phase clock signal MCLK1. Data voltages are output to a second data line group of the first block BL1_1 of the first area in response to the second multi phase clock signal MCLK2.

Alternatively, to make the first block BL1_1 of the first area have a delay time of the eighth unit time 8UI, an HH signal for the first block delay signal B1, an LH signal for the delay coefficient signal M, and the L signal for the second delay coefficient signal M2 are provided. In this case, data voltages are output to the first data line group of the first block BL1_1 of the first area in response to the first multi phase clock signal MCLK1. Data voltages are outputted to the second data line group of the first block BL1_1 of the first area in response to the ninth multi phase clock signal MCLK9 (e.g., because of the delay time of the eighth unit time 8UI).

A delay time of data voltages output to each block of the second and third areas may be controlled in substantially the same way.

Figure 8:
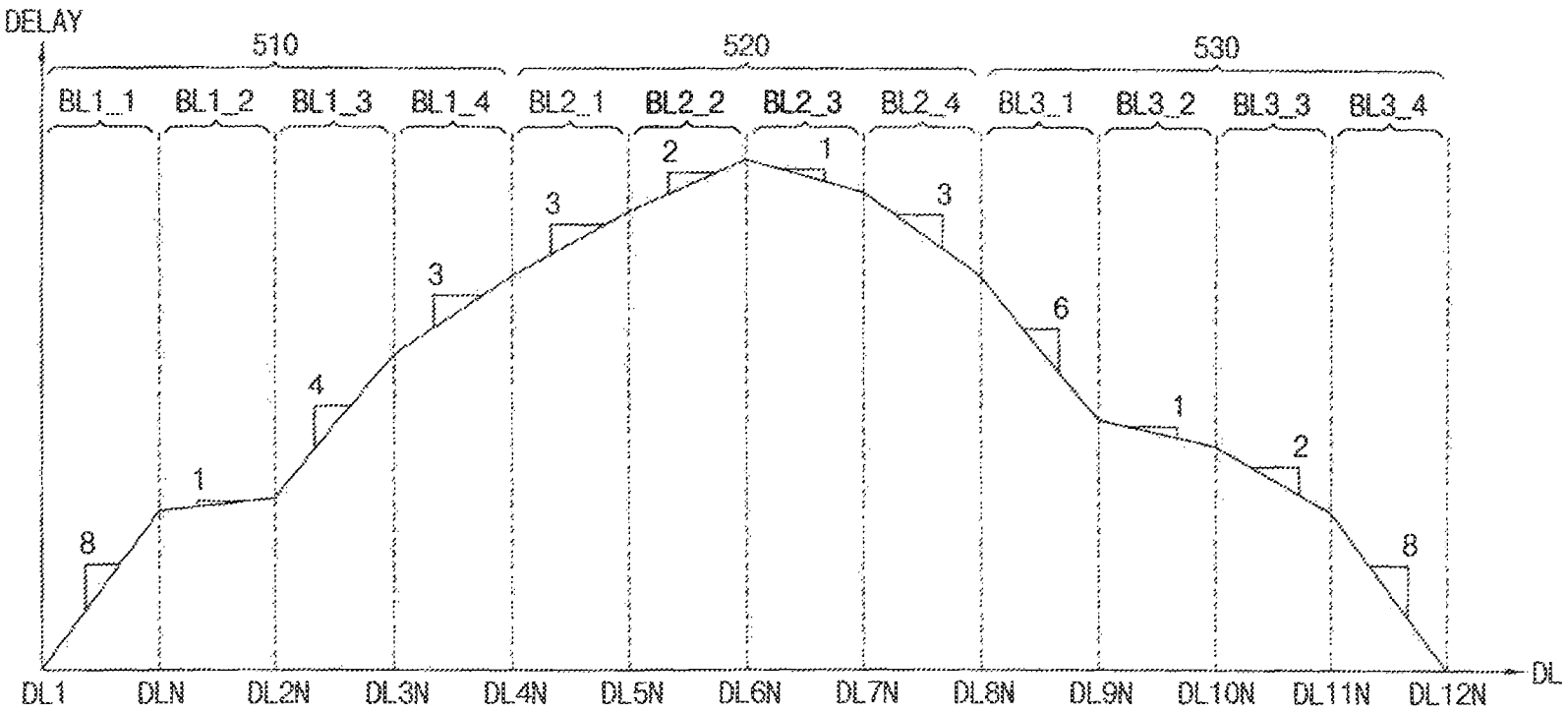
FIG. 8 is a graph illustrating an example of time gaps between data line groups for outputting data voltages for each of a plurality of blocks included in the display panel of FIG. 2 according to an exemplary embodiment of the present inventive concept.
Figure 9:
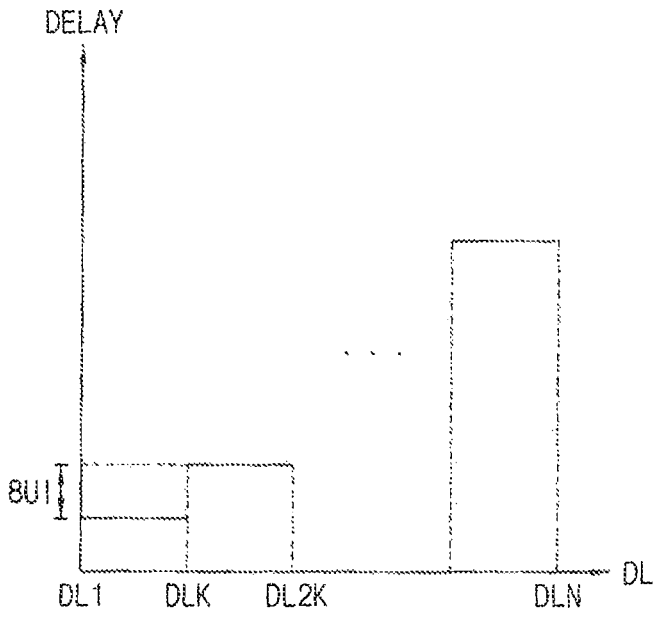
FIG. 9 is a graph illustrating an example of time gaps between data line groups for outputting data voltages for one of the plurality of blocks of FIG. 8 according to an exemplary embodiment of the present inventive concept.

FIG. 8 is a graph illustrating an example of time gaps between data line groups for outputting data voltages for each of a plurality of blocks included in the display panel of FIG. 2 according to an exemplary embodiment of the present inventive concept. FIG. 9 is a graph illustrating an example of time gaps between data line groups for outputting data voltages for one of the plurality of blocks of FIG. 8 according to an exemplary embodiment of the present inventive concept. Any repetitive explanations concerning FIGS. 1 through 6 and 7A through 7C will be omitted.

Referring to FIG. 8, each block of the first through third areas may have a different delay time and a different delay direction from one another. For example, the first block BL1_1 of the first area may have a delay time of the eighth unit time 8UI, the first block BL2_1 of the second area may have a delay time of the third unit time 3UI, and the first block BL3_1 of the third area may have a delay time of the sixth unit time 6UI.

Referring to FIGS. 6 and 9, the unit signal CH may determine a number K of data lines having substantially the same timing for outputting data voltages. For example, the first block BL1_1 of the first area that includes the first to N-th data lines DL1~DLN may have the delay time of the eighth unit time 8UI. The first to K-th data lines DL1 to DLK may have substantially the same timing for outputting the data voltages. After the delay time of the eighth unit time 8UI, the (K+1)-th to 2K-th data lines DL(K+1)~DL2K may output the data voltages with substantially the same timing.

The above-described exemplary embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

As described above, according to exemplary embodiments of the present inventive concept, data voltages having a different delay time for each block in a data driving circuit of a display panel can be generated by using a multi phase clock signal. Accordingly, the delay time of data voltages can be relatively freely controlled, so that a resistive-capacitive (RC) delay of gate signals can be compensated more accurately. Thus, display quality of the display panel can be increased.

While the inventive concept has been shown and described with reference to exemplary embodiments thereof, it will be apparent to those of ordinary skill in the art that various modifications in form and details may be made thereto without materially departing from the spirit and scope of the inventive concept as defined by the following claims.

What is claimed is:

1. A display apparatus comprising:

a display panel configured to display an image and comprising first through fourth data line groups, wherein the first and second data line groups are adjacent to each other, and the third and fourth data line groups are adjacent to each other; and a data driver comprising a first data driving circuit configured to output first data voltages to the second data line group later than to the first data line group by a first delay time, and configured to output second data voltages to the fourth data line group later than to the third data line group by a second delay time that is different from the first delay time, wherein the first and second delay times are multiples of a time gap between a plurality of multiphase clock signals.

2. The display apparatus of claim 1, wherein the data driver further comprises:

a multi phase clock generator configured to generate the plurality of multi phase clock signals in response to a clock signal.

3. The display apparatus of claim 2, wherein the first data driving circuit is configured to synchronize the first data voltages with a first multi phase clock signal and the second data voltages with a second multi phase clock signal, wherein each of the first and second multi phase clock signals is one of the plurality of multi phase clock signals, and the second multi phase clock signal is different from the first multi phase clock signal.

4. The display apparatus of claim 1, wherein the plurality of multi phase clock signals has a time gap of a first unit time between one another, and wherein the first and second delay times are multiples of the first unit time.

5. The display apparatus of claim 1, wherein the first through fourth data line groups are disposed in an order of the first data line group, the second data line group, the third data line group, and the fourth data line group.

6. The display apparatus of claim 1, wherein the first through fourth data line groups are disposed in an order of the first data line group, the second data line group, the fourth data line group, and the third data line group.

7. The display apparatus of claim 1, further comprising:

a timing controller configured to generate a delay control signal and output the delay control signal to the first data driving circuit, wherein the delay control signal includes delay information about the first and second delay times.

8. The display apparatus of claim 7, wherein the timing controller is configured to output the delay control signal during vertical blank durations between each frame.

9. The display apparatus of claim 7, wherein the delay information further includes a number of data lines included in each of the first through fourth data line groups.

10. The display apparatus of claim 1, wherein each of the first through fourth data line groups includes substantially the same number of data lines.

11. The display apparatus of claim 1, wherein the data driver further comprises a second data driving circuit.

12. A method of driving a display apparatus comprising a display panel comprising first through fourth data line groups, the method comprising:

outputting first data voltages to the second data line group later than to the first data line group by a first delay time;

outputting second data voltages to the fourth data line group later than to the third data line group by a second delay time that is different from the first delay time;

generating a delay control signal including information about the first and second delay times; and displaying an image in response to the first and second data voltages.

13. The method of claim 12, further comprising:

generating a plurality of multi phase clock signals in response to a clock signal, wherein outputting the first and second data voltages comprises synchronizing the first and second data voltages with the plurality of multi phase clock signals.

14. The method of claim 13, wherein the plurality of multi phase clock signals has a time gap of a first unit time between one another, and wherein the first and second delay times are multiples of the first unit time.

15. The method of claim 12, further comprising:

outputting the delay control signal during vertical blank periods between each frame.

16. A display apparatus comprising:

a display panel configured to display an image and comprising a plurality of blocks each including a plurality of data line groups; and a data driver configured to output data voltages, wherein each of the plurality of blocks has a different time gap between the plurality of data line groups included therein for outputting the data voltages.

17. The display apparatus of claim 16, further comprising:

a timing controller configured to generate a delay control signal and output the delay control signal to the data driver, wherein the delay control signal includes delay information about differences in time gaps of the plurality of blocks.

18. The display apparatus of claim 17, wherein the delay information further includes a delay direction of the data voltages for each of the plurality of blocks.

19. The display apparatus of claim 16, wherein the data driver comprises:

a shift register configured to receive a horizontal start signal and a clock signal and generate a plurality of latch control signals;

a latch configured to receive the plurality of latch control signals, a delay control signal, a data signal, and a load signal, and output the data signal;

a digital-to-analog converter configured to receive the data signal from the latch and a gamma reference voltage to generate the data voltages;

a multi phase clock generator configured to receive the clock signal and generate a plurality of multi phase clock signals; and a buffer configured to receive the data voltages from the digital-to-analog converter, and output the data voltages to the plurality of blocks in response to the multi phase clock signals.

20. The display apparatus of claim 1, wherein the first data driving circuit is configured to synchronize the first and second data voltages with the plurality of multiphase clock signals, and output the first and second data voltages.

* * * * *